United States Patent [19]

Finney et al.

[11] Patent Number: 5,040,846

[45] Date of Patent: Aug. 20, 1991

[54] ROCKER CHAIR

[75] Inventors: Steven E. Finney, Allendale; John P. Conner, Grandville, both of Mich.

[73] Assignee: Irwin Seating Company, Grand Rapids, Mich.

[21] Appl. No.: 464,035

[22] Filed: Jan. 12, 1990

[51] Int. Cl.[5] ..... A47C 3/02

[52] U.S. Cl. ..... 297/258; 297/264; 297/300

[58] Field of Search ..... 297/258, 261, 270, 272, 297/267, 266, 286, 287, 290, 300, 264, 265, 269; 248/618, 619

[56] References Cited

U.S. PATENT DOCUMENTS

| | | | |
|---|---|---|---|
| 1,915,480 | 6/1933 | Trainor | 248/618 |
| 2,273,980 | 2/1942 | Moody | 297/284 |
| 2,563,407 | 8/1951 | Haims | 297/258 X |
| 3,127,219 | 3/1964 | Stokke | 297/264 |
| 3,372,955 | 3/1968 | Flint | 297/300 |
| 3,740,792 | 6/1973 | Werner | 297/300 X |
| 4,119,343 | 10/1978 | Pentzien | 297/268 X |

*Primary Examiner*—José V. Chen

*Attorney, Agent, or Firm*—Price, Heneveld, Cooper, DeWitt & Litton

[57] ABSTRACT

A theater chair of the rocking type having a standard on each side for supporting the chair. A contoured spring guide is attached to each standard and provides a support and deflection profile for leaf springs held in trolleys on each side of the chair. A wing plate extends upwardly from each trolley and terminates in a guide surface. A guide roller is mounted near the top of each standard and provides lateral and longitudinal support for the guide surface the wing plate on each side of the chair. A chair seat is mounted on each trolley and a chair back is mounted between each wing plate. The chair seat and chair back move in unison in a rocking manner as the leaf springs increase and decrease contact along the surface of each spring guide.

18 Claims, 3 Drawing Sheets

ROCKER CHAIR

BACKGROUND OF THE INVENTION

The subject invention relates to public seating of the type found in theaters, auditoriums, and concert halls or the like wherein it is desired to provide enhanced comfort to the patron with quality cushioning and rocking effect. A typical installation of this type of seat is found in modern movie theaters wherein the individual seats are side-by-side providing armrests and movement of a rocking nature at the patron's election.

One type of prior art seat provides individual and interconnected chairs in row-like fashion with spaced sides extending upwardly and terminating in an armrest with pivotally mounted seats and backs interconnected to said sides. A rocker mechanism was provided having a bracket and arm interconnectably attached to the seat and back, there being a non metallic leaf spring secured to the lower portion of the bracket at one end in cantilever fashion, the opposite end being secured in cantilever fashion to the base or stationary mounting member by which the seat was supported.

The patron, upon sitting in the seat, would be provided with both a cushioning and rocking motion as the seat and back flex in a fashion similar to the operation of a diving board.

The above arrangement was initially designed with a metal spring which tended to fatigue and ultimately fail. This was replaced with a non metallic leaf spring which did not fail, but nonetheless fatigued quite rapidly to the point where the seat became overly susceptible to rocking. The spring lost its resiliency; and hence the rocking action became mushy, and the patron experienced undesirable rocking. Also, because of the cantilevered configuration of the spring, the rearward rotation of the seat and back caused undue rotation of the patron depending on the person's size such that the user's feet would rotate up off the floor in an undesired fashion.

Other drawbacks to the above-referenced seat were, over the course of time, undesired lateral movement of the seat along with its rocking motion. Inadequate stops were provided as well, allowing too much movement which resulted in uncushioned stopping of the seat when the forwardmost or rearwardmost extremity was reached.

While the seat employing the non metallic leaf spring seldom failed, rendering it useless, it became useless for its intended comfort providing purpose. Heretofore, the methodology used in constructing prior art seats also made it difficult to repair, adding an extra burden of cost in maintenance. Thus, there is a need for an improved rocker mechanism and the need for an improved control mechanism in seats of this type.

SUMMARY OF THE INVENTION

In accordance with one aspect of the invention, a theater rocking chair is provided with spaced support sides and a chair back and seat suspended between the sides. The seat and back are anchored to a trolley spaced above the support surface or floor. The trolley is supported by a spring anchored to a stationary spring support, the spring support having a nonlinear upper surface in contact with the spring to provide rocking movement of the seat and back. The upper surface of the spring support preferably defines a non-linear curved face whereby when the seat is subjected to the weight of a patron, the spring deflects along the face of the support to transmit the force of the patron through the spring to the support surface while causing a controlled rocking rotation of the seat and back. As the spring is deflected the surface area of engagement between the spring and the support increases to increase the effective spring force and increase the area of distribution of the force transmitted through the spring.

In a preferred embodiment, the spring is a non metallic leaf clamped to the support by a spring clamp which also has a non-linear surface of curvature reversed to that of the support so that as the leaf spring is deflected in one direction to increase its area of contact with the support, the upper surface is deflected in the opposite direction for increased surface contact with the clamp, further increasing the area of contact between the spring and further increasing the area of distribution of the force transmitted to the spring. This deflection and configuration acts to limit the stress on the spring. The pivotal connection of the chair back and seat relative each other and rocking attachment to the fixed base through the trolley provides a floating suspension of the person which due to the composite movement is extremely comfortable and pleasing.

In a second aspect of the invention, a rocking chair is provided whereby the sides terminate upwardly in armrests, and a guide roller is rotatably mounted beneath the armrests to the stationary side in a manner such that the movable portion of the side which rocks simultaneously with the seat and back engages the roller to guide the rocking motion both laterally and longitudinally. A removable stop is anchored to the stationary side to limit the forward rocking movement of the chair and in a preferred embodiment, the entire guide roller mechanism and preferred rocking mechanism can easily be disassembled for service. The preferred roller mechanism also provides "quiet" movement as opposed to more conventional sliding movement. The encapsulation of the preferred non metallic leaf spring and its enhanced spring rate effectiveness permits the use of less material and a dimensionally smaller non metallic spring than heretofore permitted in the cantilevered spring described as in prior art. Because of the enhanced operation of the subject invention, a more efficient, cleaner and aesthetically appearing seat is now available, the encapsulation of which avoids unnecessary dirt or dust collection and unwarranted tampering. The effective service life of the seat is greatly increased.

DETAILED DESCRIPTION OF THE PREFERRED EMBODIMENTS

Figure 1:
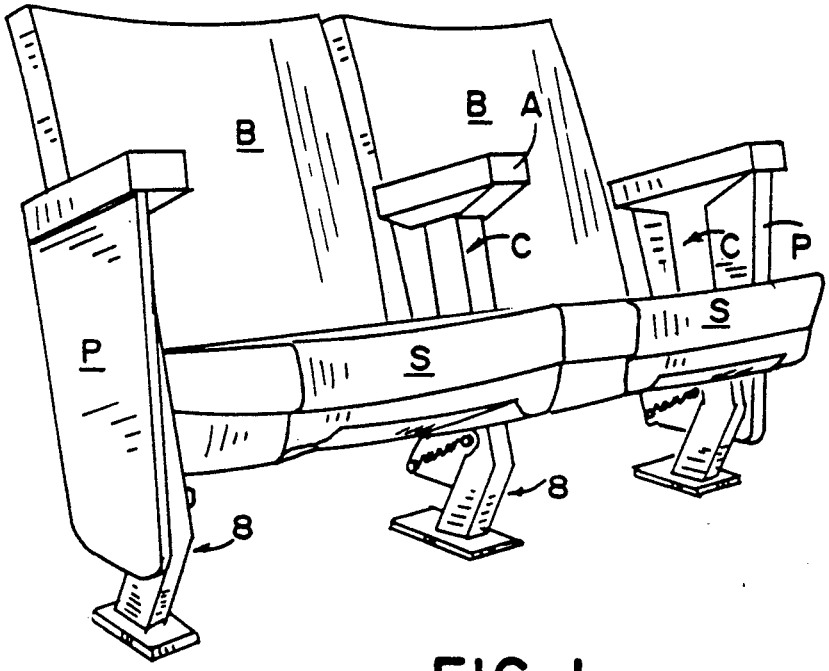
FIG. 1 is a perspective view of two theater type seats of the type for which the present invention is intended.

In FIG. 1 there can be seen a short section of theater seating of the type discussed herein. Each chair is generally comprised of a cushioned seat S and a cushioned back B adapted to rock back and forth as desired by the patron. Armrests A are provided on each end and between each seat on top of columns C, the seats being supported by an assembly 8 to be described in more detail hereinafter. The ends of each row are preferably covered by a panel P.

Figure 2:
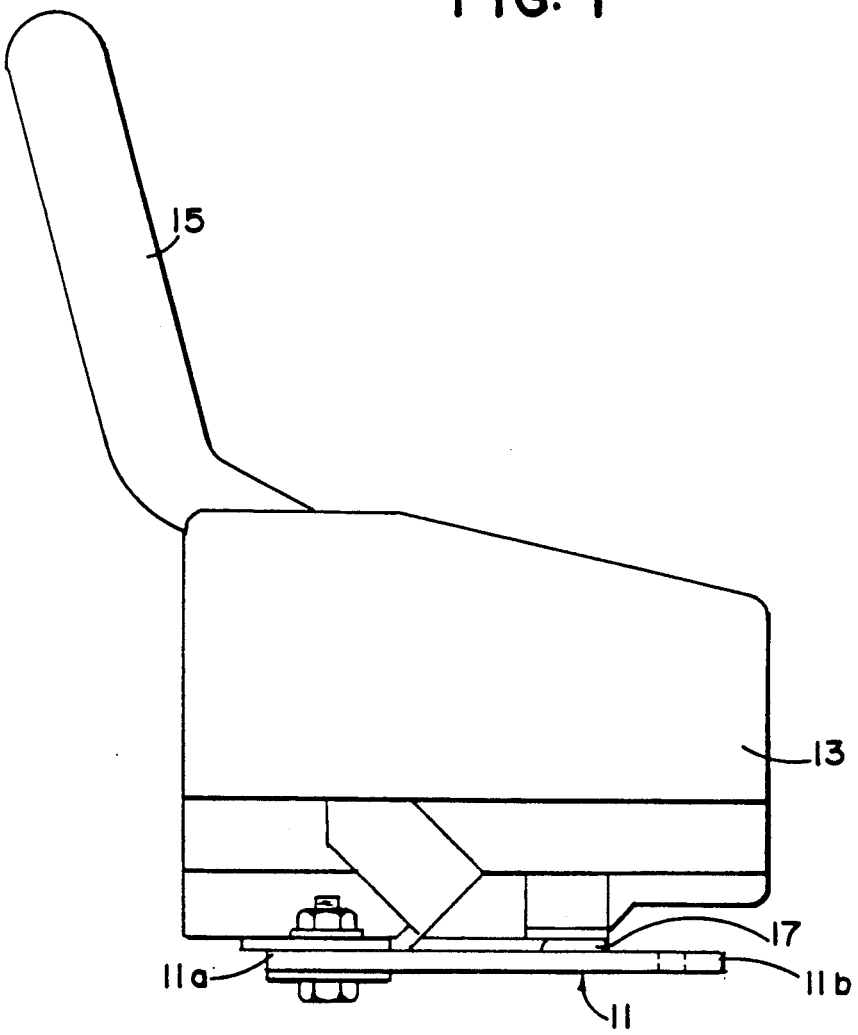
FIG. 2 PRIOR ART
FIG. 2 is an enlarged view of a prior art seat support rocker mechanism.

In the past, the rocking function was accomplished using a rocker mechanism of the type illustrated in FIG. 2, one such mechanism being used on each side of the chair seat and back. In this construction, a cantilevered fiberglass leaf spring 11 is attached at one end 11*a* to an anchor frame member 13. The seat (not shown) was pivotally anchored to frame 13 and the back (not shown) was secured to the frame arm 15. By anchoring the end 11*b* of spring 11 to the floor support (not shown), spring 11 would bend down when the person sat in the chair and could rock back lifting the padded stop 17 off of the top surface of the spring 11. When the seat was rocked forward, stop 17 limited the forward movement. While chairs employing this type of support have been successfully used, it was found over a period of time that the leaf spring 11 would become very limber so that patrons would find it difficult to sit in the chair without either being completely forward, not using the rocking function, or rocked backward to the point where the person's feet might even come off of the floor of the theater.

Figure 3:
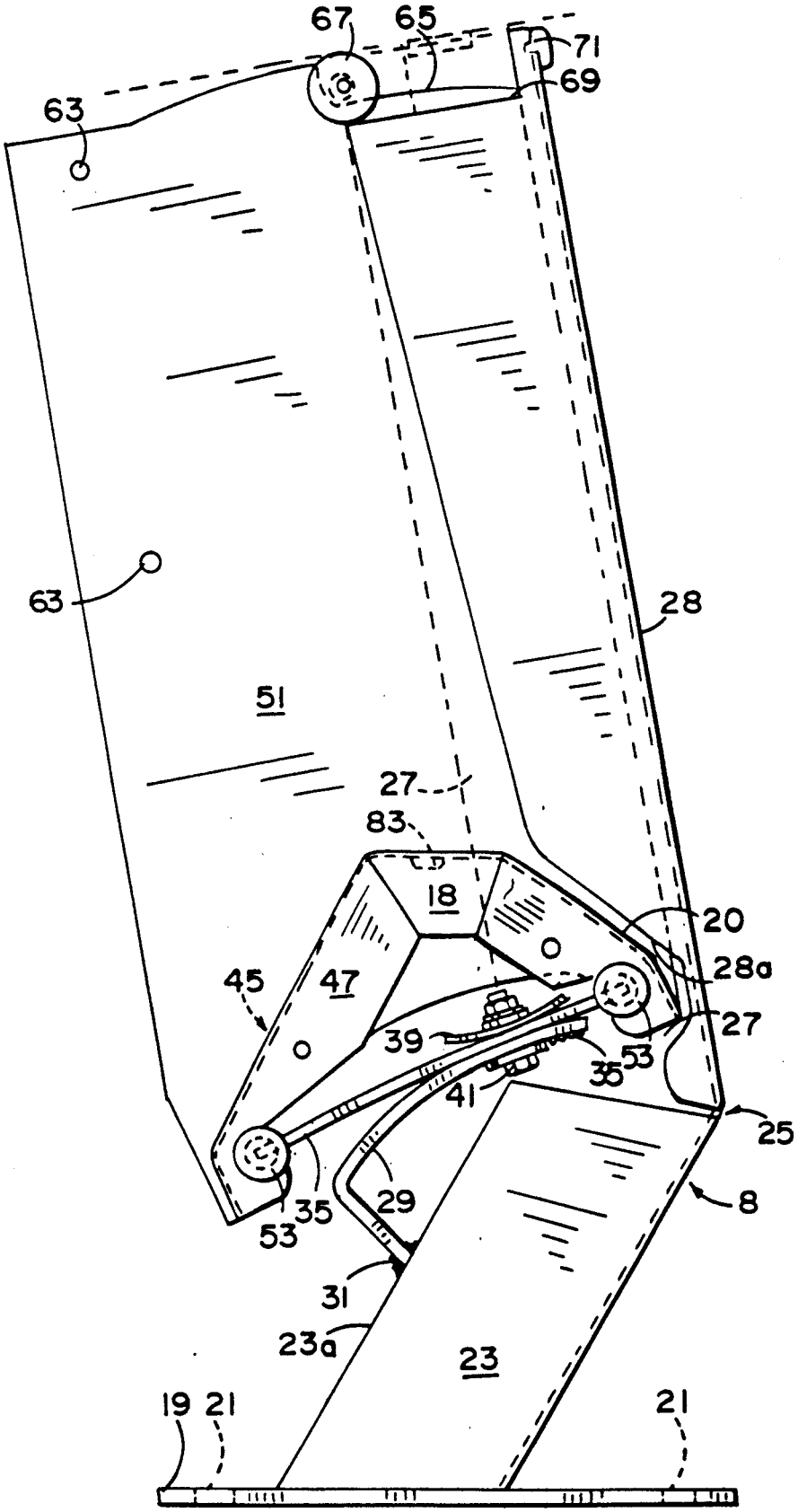
FIG. 3 is a side elevational view of the improved rocker and guide mechanism of the subject invention.
Figure 7:
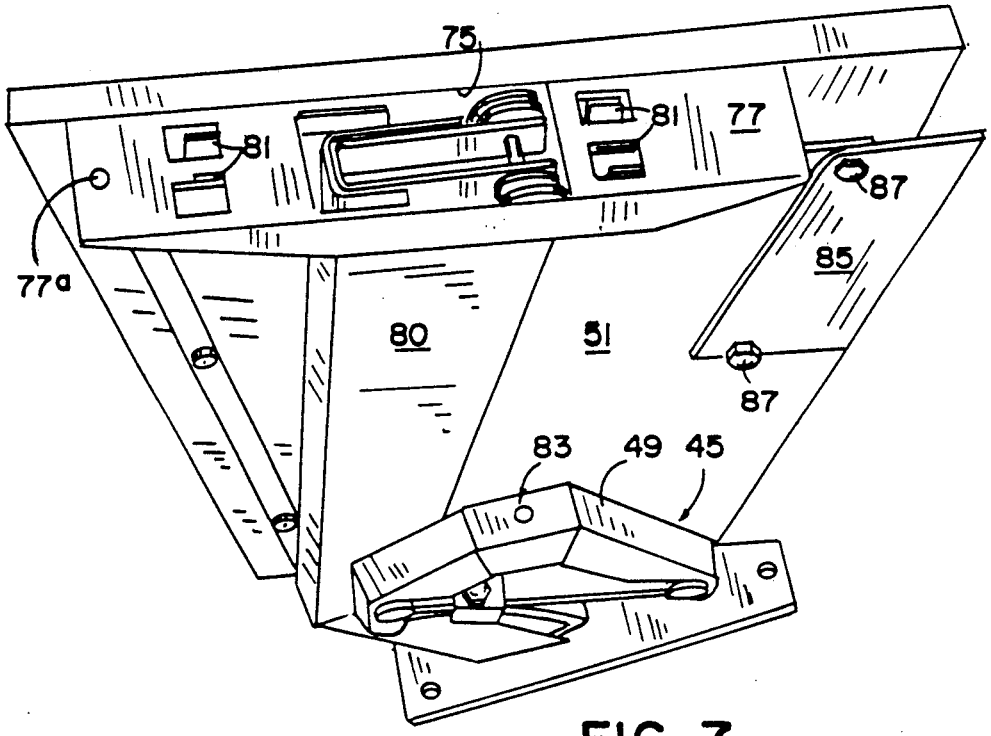
FIG. 7 is a top perspective view of one side of the chair support and arm rest with the arm rest pad removed.

In order to overcome the above-mentioned problems and in accordance with the present invention, a new preferred seat support 8 and rocking system is shown in FIG. 3. In this figure, only one side of the chair support is shown. The opposite side of the chair would have the mirror image of the support shown in FIG. 3 so that the chair seat and back could be mounted between the two support assemblies. Each support is symmetrical to permit attachment to adjacent seats. In the assembly shown in FIG. 3, a footpad 19 is shown which supports the chair on the floor or riser as the case may be if the seating is tiered. In FIG. 7, the support shown has an end panel "P" covering one side for use at row ends.

Each support 8 includes a footpad 19 having apertures 21 therein to facilitate bolting the foot pads in place to the floor or riser. A tubular steel standard 23 is preferably welded to the footpad 19 and is supported upwardly and at a forward angle to a point 25 where the tubular steel standard is continued at a reversed angle by a second tubular piece 27 which extends to and supports the armrest channel component or support 77. Preferably, tubular pieces 23 and 27 are welded together at 25.

Figure 4:
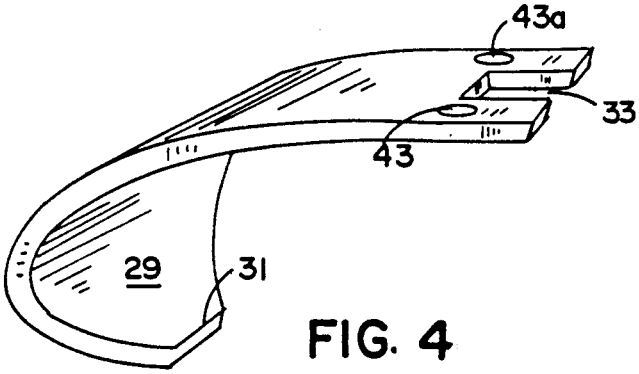
FIG. 4 is a perspective view of the preferred spring support of the invention.

A configurated spring support 29 is welded at one end 31 onto the rear surface 23*a* of the lower tubular standard 23. The spring support extends rearwardly from the back of the standard 23 and then curves in a non-linear manner upwardly back toward the standard where, as can be seen in FIG. 4, a notch 33 enables the spring support to straddle the upstanding tubular standard 27. This end of the spring support is welded as at 34 along the notch to firmly and rigidly fix or secure the support to tubular element 27. This relationship permits rotational or rocking movement of trolley 45 relative to standards 23 and 27 as the user or patron moves. As will be described, each support 29 supports two separate springs, one each from adjacent seats.

A flat fiberglass reinforced non metallic leaf spring 35 is fastened by clamp 39 to one side of the spring support 29. The clamp, when in place, has a general curvature opposite that of support 29. The clamping function is provided by a suitable nut and bolt combination 41 which passes through one of the two apertures 43, 43*a* (FIG. 4) in the spring support 29. An aperture is provided through spring 35 to receive the bolt. The aperture is located off center longitudinally to reduce the stress on the spring as will be described.

Figure 5:
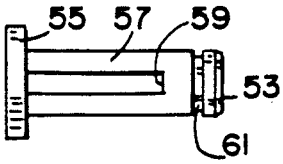
FIG. 5 is an elevational view of a slotted pin used to hold one end of a leaf spring.

A trolley member indicated generally by the number 45 has spaced sides 47 and adjoining web portion 49 (FIG. 7) forming a generally inverted U-shaped member. Trolley 45 is fastened to a wing plate 51, preferably by welding. The combined wing plate 51 and trolley 45 is then rockingly supported by spring 35 by a pair of non metallic (preferably Delrin) pins 53. Each pin (FIG. 5) has an enlarged head 55 at one end which is joined to an elongated body 57 which has a longitudinal slot 59. Slot 59 does not extend through the diameter of pin 53 so that it acts as a seat for each end of the spring. A groove 61 is provided at the opposite end of body 57 for receiving a "C" clamping ring (not shown) for holding the pin 53 in place.

As can be seen in FIG. 3, one pin 53 is used at each end to fasten the leaf spring 35 to the trolley 45 in a hook-like opening formed in each end of the trolley. The concave faces of each hook-like opening face each other and receive and contain the pins 53 which hold each end of leaf spring 35. Once fastened, the wing plate 51 and trolley can rock on spring support 29. As the wing plate 51 and trolley 45 move backward or to the left, as shown in FIG. 3, the leaf spring 35 will increase surface contact with the non-linear deformation surface of the spring support 29, in effect increasing the strength of the leaf spring as it bends. The forward portion of the leaf spring will tend to lift as the trolley 45 rocks bringing the upper surface of the leaf spring 35 into contact with the forward portion of the contoured lower face of clamp 39. Upon forward rocking, the leaf spring flexes in the opposite direction again increasing its upper and lower surface contact with support 29 and clamp 39. The off-center mounting of spring 35 allows greater surface utilization of spring 35 since the more extensive loading occurs during rearward rocking. The combination provides a natural rearward stop or limit which is a function of the weight of the patron. It can be seen then that the leaf spring 35 is controlled at each end during the rocking process. A physical forward stop is also provided and will be described hereinafter.

Figure 6:
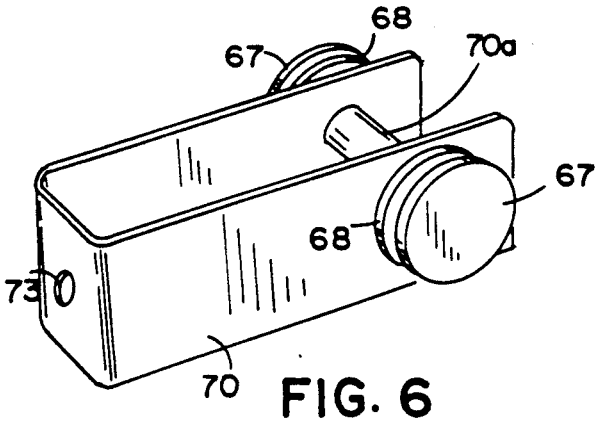
FIG. 6 is a perspective view of a bracket and supported guide roller.

The wing plate 51 has a pair of apertures 63, as shown in FIG. 3, which are used to support and mount the back of the seat. The top forward edge of the wing plate is shaped at 65 to form a curved guide surface which moves within stationary roller 67. The forward edge 69 of the wing plate 51 contacts up-stop 71 to prevent further forward motion of the chair. The up-stop 71 is made of an elastomeric material such as polyurethane and is attached over the upper edge of a decorative shroud 28 which covers the forward end of wing plate 51. The up-stop 71 stops the forward motion of the wing plate 51 and in turn the seat and chair back while the shaped surface 65 can pass through the groove 68 in grooved roller 67, referring to FIG. 6, where it is guided both laterally and longitudinally during the rocking motion of the chair. It will be appreciated that wing plate 51 moves relative to shroud 28 which is stationary. Shroud 28 has a lower cutout or cutaway portion 28*a* to facilitate concurrent movement of trolley 45 with wing plate 51. It will be appreciated that shroud 28 is U-shaped and accommodates attachment and movement of a second wing plate on the opposite side of tubular standard 27 to accommodate movement of the adjacent seat.

Referring again to FIG. 6, a U-shaped bracket 70 supports the stationary rollers 67 on an axle 70*a* which passes through an aperture in each side of the bracket. The bracket 70 is intended to be supported by a bolt and nut mounted through the aperture 73 in the web portion of the bracket 70. The bracket is removably fastened to the top of tubular steel standard 27, as shown in FIG. 7. The bracket is bolted to the tube as can be seen through the aperture 75 in an arm channel component 77. The arm channel component 77 is fastened, preferably by welding, to the upper tubular steel standard 27. Integral steel tabs 81 are provided on the top of the arm channel component 77 to removably hold the decorative armrest pad A (FIG. 1). An aperture 77*a* is provided near the leading edge of the arm channel component 77 for a locking screw to pass through to hold the armrest pad securely in position. This eliminates removal of the armrest by a patron but permitting easy removal for maintenance.

Up-stops 71 and rollers 67 can easily be replaced in this fashion. By removing the armrest, the roller bracket 70 can be removed by unscrewing the fastener through aperture 73 (FIG. 6) whereby the rollers are held by friction on axle 70*a*. The up-stops 71 can simply be lifted out and replaced. Preferably, rollers 67 are cone shaped or outwardly convex (FIG. 6) to reduce potential side contact area with the stationary armrest. This greatly reduces any potential noise.

The seat for the rocking chair is fastened by any suitable means, preferably by bolting, through the aperture 83 (FIGS. 3 and 7) centrally located on the top web of the trolley 45. The chair seat is preferably pivotally supported, so that it can be tilted up out of the way when not in use. The seat back is attached on either side to the wing plate 51 by means of a bracket 85 and spaced bolts 87 which pass through the apertures 63 in the wing plate 51. The chair back is fastened to a pair of spaced wing plates 51 which are attached to the respective trolleys holding the chair seat. The entire chair seat and chair back assembly can then rock using the fiberglass leaf spring for support on the surface of the spring support 29. Guide rollers 67 facilitates rocking movement of the seat and back as though it were in a track eliminating undesired lateral movement and noise created by conventional sliding parts.

It can be seen that the chair support of the present invention provides an improved assembly for controllably supporting the rocking chair and seat. It has been found that the use of the spring support 29 enables a dimensionally smaller spring to be used for the leaf spring 35. The effect felt by the patron is a "floating" suspension. As previously noted, the spring support 29 is designed and is wide enough to hold the leaf spring assembly on two adjacent seats.

Though the invention has been described with respect to a specific preferred embodiment thereof, many variations and modifications will become apparent to those skilled in the art. It is therefore the intention that the appended claims be interpreted as broadly as possible in view of the prior art to include all such variations and modifications.

The embodiments of the invention in which an exclusive property or privilege is claimed are defined as follows:

1. An assembly for providing rocking movement for a chair seat and chair back comprising:

a pair of floor pads for use in supporting said assembly on a support surface;

a pair of upstanding standards for said assembly, each of said standards having a front and a rear surface joined by opposed side surfaces, one standard being mounted on each of said floor pads;

a pair of spring supports disposed on the rear surface of each of said upstanding standards, each of said spring supports having a non-linear upwardly curved face;

a pair of movable chair seat and chair back support assemblies, each assembly comprising:

a wing plate member for supporting a chair back;

a trolley member for supporting a chair seat mounted on the side of said wing plate near the bottom thereof, said trolley having a generally inverted U-shape with a hook-like recess near each end thereof, said hook-like recesses facing each other;

a spring holding pin with a longitudinal slot therein disposed in and supported by the hook-like recess at each end of said trolley; and a leaf spring held by said spring holding pins in said trolley; and a clamp for fastening each of said leaf springs to said spring supports on said upstanding supports to provide for rocking movement of said chair back and chair seat support assembly.

2. An assembly as set forth in claim 1 wherein an arm channel member is disposed on the top of each standard of said pair of upstanding standards and has an aperture therein;

a U-shaped bracket is disposed in said aperture and is attached to said upstanding standard near the top edge thereof;

a pair of grooved guide rollers are supported by said U-shaped bracket, said grooved guide rollers provide both lateral and longitudinal support for the upper edge of said wing plates on a pair of adjacent rocking chairs, a decorative shroud covers the upper portion of said upstanding standards and a portion of said wing plate; and an up-stop is disposed over the top edge of said decorative shroud on each side of said U-shaped brackets to stop the forward motion of the leading edge of said wing plate as said chair assembly moves.

3. An assembly according to claim 1 wherein said leaf spring has a top and bottom face, said bottom face being joined at least at one point to said curved face of said spring support, said curved face extending downwardly away from the bottom face of said leaf spring, said spring when subjected to the weight of a person in a chair seat deflecting downwardly along the curved face of said support increasing the area of contact between said faces of said leaf spring and spring support.

4. An assembly according to claim 1 wherein said spring support face has a forward portion extending toward said standard, said forward portion of which curves in spaced relationship downwardly away from the face of said leaf spring, said leaf spring deflecting downwardly when the weight of a person is shifted or applied forwardly increasing the area of contact between said faces of said spring and support.

5. An assembly according to claim 1 wherein said clamp has an area of contact with said leaf spring, a portion of said spring being clamped between said spring clamp and said spring support, said spring clamp extending forwardly and rearwardly of said area of contact, said spring when deflected to increase the facial contact of said spring with the rearwardly extending face of said support causing the upper surface of said spring to increase its facial contact with the forwardly extending lower surface of said spring clamp, and when said chair is rocked forwardly such that the spring is deflected to increase the facial contact of said spring with the forwardly extending face of said support causing the upper surface of said spring rearwardly of said area of contact to increase the facial contact with the lower surface of said spring clamp extending rearwardly of said anchor.

6. A rocking chair comprising:

a pair of foot pads for said rocking chair;

an upstanding support positioned on each of said foot pads for supporting each side of said rocking chair;

a spring support attached to each of said upstanding supports;

a leaf spring on each of said spring supports;

a trolley member attached to each of said leaf springs and supported thereby, said trolley having a pair of spaced sides joined by a connecting web in a generally inverted U-shaped configuration;

a wing plate attached to each of said trolleys and extending upwardly from each of said trolleys to form a guide surface;

a bracket mounted near the top of each of said upstanding supports;

a pair of spaced guides supported by said brackets for providing lateral and longitudinal support for the guide surface on each of said wing plates;

a chair seat mounted on said trolleys;

a chair back mounted between said wing plates, said chair seat and chair back being mounted to rock in unison as said trolley and leaf spring move on said spring support.

7. A rocking chair as set forth in claim 6 wherein said pair of spaced guides comprise a pair of grooved rollers for receiving said guide surface on said wing plates.

8. A rocking chair as set forth in claim 7 wherein each of said grooved rollers has opposed inner faced bounding each side of said groove and outer faces which are outwardly convex.

9. An assembly for supporting one side of a chair seat and a chair back in a rocking fashion on an upstanding standard comprising:

a spring support attached in a cantilevered manner to a side of said upstanding standard, said spring support having a curved surface extending in a first direction away from said upstanding standard and continuing in a second direction toward said upstanding standard;

a clamp;

a leaf spring fastened to said spring support by said clamp and extending over and having portions spaced from said spring support on either side of the point where said leaf spring and spring support are fastened together;

an inverted substantially U-shaped trolley member attached to each end of said leaf spring;

a wing plate attached to said trolley member, said wing plate extending upwardly from said trolley member and ending in a formed guide surface; and a guide connected to said upstanding standard for receiving and controlling said guide surface on said wing plate to control the lateral and longitudinal motion of said wing plate.

10. An assembly for providing rocking motion for a chair comprising:

a spring support for attachment to a standard, said support having a curved surface;

a leaf spring for attachment to said spring support, said leaf spring having free ends;

a chair seat supporting trolley, said trolley having a pair of opposed recessed faces for receiving the free ends of said leaf spring, said trolley being supported by said leaf springs, said trolley causing said leaf spring to conform to varying portions of the curved surface on said spring support as said chair seat undergoes rocking action.

11. An assembly for providing rocking motion for a chair as set forth in claim 10, including a wing plate for supporting a chair back attached to said trolley whereby said chair back and chair seat can rock in unison.

12. An assembly for providing rocking motion for a chair as set forth in claim 10, wherein said spring support is designed for cantilevered attachment to said standard.

13. An assembly for providing rocking motion for a chair as set forth in claim 10, wherein said spring support is wide enough to support the two leaf springs from a pair of adjacent assemblies.

14. An assembly for providing rocking motion for a chair as set forth in claim 13, wherein said clamp has a curved working face for contacting said leaf spring as said leaf spring rises away from said curved surface on said spring support as said chair undergoes rocking action.

15. An assembly for providing rocking motion for a chair as set forth in claim 10, wherein said spring support has an aperture therein and said leaf spring has an aperture therein for alignment with the aperture in said spring support, a clamp having an aperture therein and a fastener extending through the aperture in said clamp, said spring support and said leaf spring and joining said leaf spring and said clamp together on said spring support.

16. An assembly for providing rocking motion for a chair as set forth in claim 10, including a guide surface connected to said standard for controlling the lateral and longitudinal movement of said wing plate as said chair undergoes rocking action.

17. An assembly for providing rocking motion for a chair as set forth in claim 16, wherein said guide surface comprises a roller having a recess in its surface for receiving a portion of said wing plate; and a bracket connected to said standard for supporting said roller.

18. A guide for the chair back supporting member of a rocking chair assembly, said rocking chair assembly being supported by a stationary upstanding standard comprising:

bracket means adapted to be attached to said standard;

a guide means supported by said bracket means for receiving a portion of said chair back supporting member and for providing lateral and longitudinal support as said chair back supporting member moves as said chair rocks, said guide means comprising a grooved roller supported by said bracket means.

* * * * *